US007871389B2

(12) United States Patent
Plake et al.

(10) Patent No.: US 7,871,389 B2
(45) Date of Patent: Jan. 18, 2011

(54) STRUCTURAL ELEMENT FOR A SPORTS SHOE, SUCH AS A SKI BOOT, SNOWBOARDING BOOT, TREKKING BOOT, OR SUCH LIKE

(75) Inventors: Glen Plake, Silver Springs, NV (US); Florio Gazzola, Casella D'Asolo (IT)

(73) Assignee: Calzaturificio Dal Bello SRL, Casella D'Asolo (IT)

( * ) Notice: Subject to any disclaimer, the term of this patent is extended or adjusted under 35 U.S.C. 154(b) by 207 days.

(21) Appl. No.: 11/805,731

(22) Filed: May 24, 2007

(65) Prior Publication Data

US 2007/0271825 A1 Nov. 29, 2007

(30) Foreign Application Priority Data

May 26, 2006 (IT) ..... UD2006A0131

(51) Int. Cl.
*A61F 5/00* (2006.01)

(52) U.S. Cl. ..... 602/23; 602/27

(58) Field of Classification Search ..... 602/16, 602/27, 23; 36/117.1, 118.2, 118.3, 118.4
See application file for complete search history.

(56) References Cited

U.S. PATENT DOCUMENTS 4,561,196 A 12/1985 Petrini et al.
5,197,209 A * 3/1993 Rolland et al. ..... 36/118.9
5,249,377 A * 10/1993 Walkhoff ..... 36/117.7
5,519,951 A * 5/1996 Paris ..... 36/117.6
5,720,119 A 2/1998 Benoit
5,921,006 A * 7/1999 Vargas, III ..... 36/118.2
7,040,042 B2 * 5/2006 Light ..... 36/117.1

FOREIGN PATENT DOCUMENTS

| | | |
|---|---|---|
| DE | 19 63 342 | 6/1971 |
| EP | 0 229 638 | 7/1987 |
| EP | 0 717 938 | 6/1996 |
| FR | 2 506 135 | 11/1982 |

* cited by examiner

*Primary Examiner*—Michael A. Brown
(74) *Attorney, Agent, or Firm*—Hamre, Schumann, Mueller & Larson, P.C.

(57) ABSTRACT

A structural element for a sports shoe provided with a casing able to be selectively configured between a first rigid condition and a second flexible condition. The structural element comprises a tongue, shaped and provided at least with a first segment, or lower segment, attached to the casing, and a second segment, or upper segment, pivoted to the first segment, so as to be selectively taken to a first operating position in which the second segment is rigidly aligned with the first segment, and a second operating position in which the second segment is free to incline with respect to the first segment and substantially follows the movement of the tibial zone of the user's leg.

7 Claims, 1 Drawing Sheet

STRUCTURAL ELEMENT FOR A SPORTS SHOE, SUCH AS A SKI BOOT, SNOWBOARDING BOOT, TREKKING BOOT, OR SUCH LIKE

FIELD OF THE INVENTION

The present invention concerns a structural element for a sports shoe, such as for example a ski boot, snowboarding boot, trekking boot, or suchlike, by means of which it is possible to obtain both an elastic support, contrasting against the front flexion of the leg during some steps of sporting practice, and also a protection against impacts in the front part, and also a partial hydraulic seal of the shoe, that is, a partial impediment against water, snow or earth, to stop them penetrating inside the shoe. The structural element according to the present invention comprises a tongue having one end attached to the casing of the shoe and shaped so as to allow the selective configuration of the sports shoe between a first rigid condition, used during the sporting activity, and a second flexible condition which facilitates walking and makes the shoe more comfortable during pauses of inactivity.

Here and in the following description and claims, by casing of the shoe we mean the combination of the structural part covering the tarsal and metatarsal zone of the foot and the shank disposed to cover the tibial zone of the leg.

BACKGROUND OF THE INVENTION

It is known that many sports shoes, including mountain boots, and in particular boots for ski mountaineering, normally consist of a casing, closed at the front in the tarsal and metatarsal zone of the foot by means of a shaped rigid tongue, with the main structural function of supporting the forward weight and of facilitating the return to position and putting on the shoe. Moreover, the tongue creates a protection against impacts, and prevents water, snow or other from penetrating inside the shoe through the front aperture of the casing.

In particular, but not only, in ski mountaineering boots, where the sporting activity alternates between walking and downhill skiing, the boots are provided with clamping and release mechanisms, for example disposed in the rear part of the casing, which allow selectively to make the reciprocal movement of the tarsal part and the metatarsal part of the casing rigid or flexible.

In fact it is known that, in order to limit the risk of accidents and to improve the skiing conditions, it is preferable to reciprocally stiffen the parts of the casing, whereas to facilitate walking these parts of the casing are reciprocally loosened and made more flexible, to allow a more comfortable articulation of the ankle, yet without having to open the boot and compromise the correct positioning of the foot inside it.

Known boots for ski mountaineering however are mainly oriented to the walking condition, to the disadvantage of the skiing condition, which therefore is not optimum and not sufficiently controlled.

Moreover, to allow walking, it is necessary to open not only the clamping mechanism but also the auxiliary closing systems, such as hooks, Velcro straps or other, present on the upper part of the shoe.

In the flexible condition, the tongue of the boot remains rigid, however, creating a partial impediment to the action of walking, and knocks with its upper edge against the tibial zone of the user's leg and, at the same time possibly causing blisters and slight traumas.

Sports shoes are also known provided with an at least partly flexible tongue which, however, if on the one hand facilitates walking, on the other hand does not allow to control the shoe during skiing.

One purpose of the present invention is therefore to achieve a structural element for a sports shoe which, in the rigid condition, or skiing condition, of the shoe, allows a correct posture of the tarsal and metatarsal part of the foot in order to limit the risk of accidents and to improve the conditions of the sports activity, and which, in a flexible condition, or walking condition, of the shoe, substantially facilitates the movement of articulating the foot without knocking against the tibial zone of the leg.

Another purpose of the present invention is to achieve a structural element for a sports shoe which allows to pass from the rigid condition to the flexible condition of the shoe without needing to open the possible closing elements of the upper part of the shoe.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other innovative characteristics of the invention.

The structural element according to the present invention is applicable to a sports shoe, such as for example a ski boot, a snowboarding boot, a trekking boot or suchlike, provided with a casing able to be selectively configured between a first rigid condition, used for example during the sporting activity, and a second flexible condition able to facilitate walking and to make the shoe more comfortable during other steps of use, in any case preventing the foot from coming out of the sports shoe.

In accordance with the above purposes, the structural element according to the invention comprises a shaped tongue, provided with at least a first segment, or lower segment, attached to the casing in correspondence with a tarsal and metatarsal zone of the latter, and a second segment, or upper segment, transversely pivoted in correspondence with a free end of the first segment, and disposed substantially as an extension thereof. The second segment is configured to be selectively disposed in a first operating position in which it is rigidly aligned with the first segment, and a second operating position in which, on the contrary, it is free to incline with respect to the first segment and to substantially follow the movement of the tibial zone of the user's leg.

The solution according to the present invention thus provides that the tongue, which extends to substantially cover the user's whole tibial zone, also adapts to the operating conditions of the casing, on the one hand, without compromising the functions of the sports activities involved and, on the other hand, without negatively interfering with the tibial zone of the leg.

In fact, when the casing is configured in its rigid condition, for example suitable for skiing, due to the effect of the normal thrusting action of the tibial zone of the leg on the tongue, the second segment of the tongue being disposed in its first operating position, it resists or contributes to resisting this thrust, guaranteeing the correct posture of the tarsal and metatarsal part of the foot.

Alternatively, when the casing is configured in its flexible condition, for example suitable for walking, the second segment of the tongue is located in its second operating position, and follows the movement of the tibial zone of the leg during normal walking, hence without knocking against it, or limiting its movement.

In one form of embodiment of the present invention, the second segment of the tongue at least partly overlaps the terminal part of the first segment, so as to increase the resistance to the tibial thrust in its first operating position.

According to a variant, the second segment of the tongue is transversely provided with a rib functioning as a shoulder, able to rest on an upper edge of the first segment, to further increase the conditions of resistance to the tibial thrust.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 2:
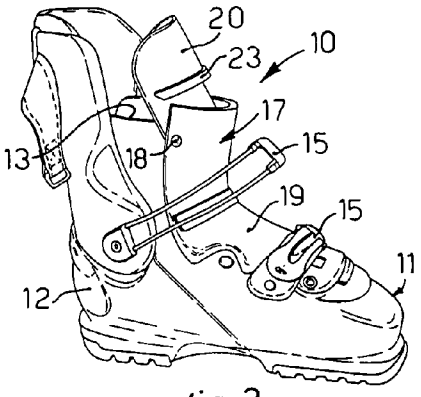
FIG. 2 is a lateral view of the structural element in a second operating condition.
Figure 3:
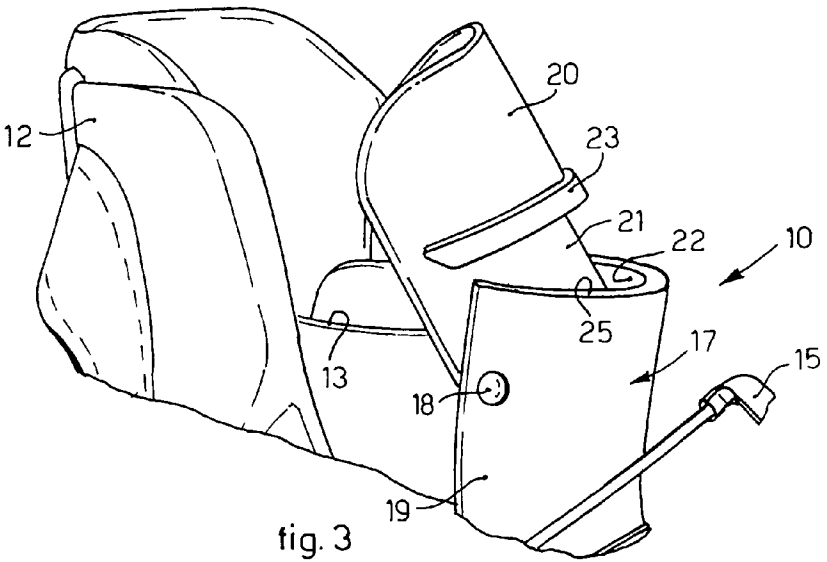
FIG. 3 is a three-dimensional view of a detail of the structural element according to the invention.
Figure 1:
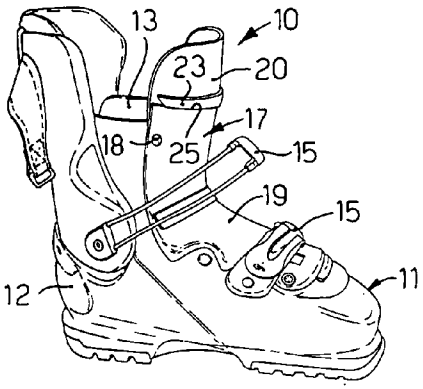
FIG. 1 is a lateral view of the structural element according to the present invention applied to a ski boot, in a first operating condition.

With reference to FIG. 1, a structural element 10 according to the present invention is applied to a ski boot 11 of the type having at least a casing 12, equipped with a front aperture 13 able to be selectively closed by means of closing mechanisms 15 disposed in specific zones of the boot 11 in order to guarantee a sufficient closing of the latter with respect to the user's foot.

The casing 12 is able to be selectively configured between a first rigid condition usable, for example but not only, during downhill skiing, and a second flexible condition able to render the ski boot 11 more comfortable during walking, for example during activities such as ski mountaineering or suchlike.

The structural element 10 according to the present invention comprises a rigid protective tongue 17 consisting of a first lower segment 19 and a second upper segment 20 pivoted to one end of the first segment 19 and disposed substantially as an extension thereof.

In this case, the second segment 20 is pivoted to the first segment 19 by means of two rivets 18, of which only one is visible in the drawings, disposed in corresponding lateral zones of the two segments 19 and 20. It cannot be excluded that the pivoting can be effected according to different techniques, for example with brackets, screws, pins or other, also made directly on one or both of the two segments 19 and 20.

The first segment 19 of the rigid tongue 17 is substantially shaped like an L-shaped tile, it is disposed above the front aperture 13 in correspondence with a tarsal and metatarsal zone of the foot, so as to prevent water, snow or other from penetrating inside the boot 11, and is attached to the casing 12 with a first end in a zone of the casing 12 where the front aperture 13 is not present.

The second segment 20 of the rigid tongue 17 is transversely pivoted, by means of a pin, a plug or other, to the first segment 19 in correspondence with a second end, so that said second segment 20 is disposed in correspondence with a substantially tibial zone of the user's leg.

In this case, the pivoting of the first segment 19 and the second segment 20 is effected so that, in a first operating position, the second segment 20 partly overlaps the first segment 19 and rests, with an overlapping surface 21, against a rear surface 22 of the first segment 19.

In this first operating condition, the two segments 19 and 20 are rigidly aligned with respect to each other and support the possible thrust of the tibia which is normally applied by the skier on the tongue 17 during the downhill skiing step.

In this case, the second segment 20 comprises at the front part a transverse rib 23, functioning as a shoulder, able to rest, in this first operating condition, on an upper edge 25 of the first segment 19, so as to improve the supporting conditions thereof and to further stiffen the condition of alignment between the two segments 19 and 20 of the tongue 17.

The pivoting of the first segment 19 and the second segment 20 allows the latter, in a flexible condition of the casing 12, to incline freely with respect to the first segment 19 and to follow substantially the movement of the tibia, in particular during the natural walking movements made, for example, during uphill ascent in ski mountaineering, substantially without knocking against the user's tibia.

It is clear, however, that modifications and/or additions of parts may be made to the structural element 10 as described heretofore, without departing from the field and scope of the present invention.

For example, it comes within the field of the present invention to provide one or more temporary clamping means able to selectively consolidate the positioning of the second segment 20 at least in the first operating condition. The temporary clamping means, according to some variants, can comprise one or more snap-in or pressure buttons, Velcro® tapes disposed respectively on the surfaces 21 and 22, or other.

It is also clear that, although the present invention has been described with reference to specific examples, a person of skill in the art shall certainly be able to achieve many other equivalent forms of structural element for shoes, having the characteristics as set forth in the claims and hence all coming within the field of protection defined thereby.

The invention claimed is:

1. A structural element for a sports shoe provided with a casing able to be selectively configured between a first rigid condition and a second flexible condition, the structural element comprising:

a shaped tongue, which is provided at least with a lower segment, attachable to the casing, and an upper segment, pivotably fastened to said lower segment in the tibial zone of the user's leg, said lower segment having an L-shape, said structural element selectively moving between a first operating position in which said upper segment is rigidly aligned with said lower segment, and a second operating position in which said upper segment is free to incline with respect to said lower segment and is able to substantially follow the movement of the tibial zone of the user's leg.

2. The structural element as in claim 1, wherein said upper segment is disposed substantially as an extension of said lower segment.

3. The structural element as in claim 1, wherein said upper segment at least partly overlaps said lower segment.

4. The structural element as in claim 1, wherein said upper segment is transversely provided with a rib functioning as a shoulder and able to rest on an upper edge of said lower segment.

5. The structural element as in claim 1, wherein said lower segment is disposed substantially in correspondence with the tarsal and metatarsal zone of the user's leg.

6. The structural element as in claim 1 comprising a sports shoe.

7. The structural element as in claim 1, including pivotably fastening said upper segment to said lower segment with a pair of rivots.

* * * * *